US007112739B2

(12) United States Patent
Mori et al.

(10) Patent No.: US 7,112,739 B2
(45) Date of Patent: Sep. 26, 2006

(54) ELECTRONIC PERCUSSION INSTRUMENT

(75) Inventors: Chiharu Mori, Hamamatsu (JP); Kazuaki Inoue, Inasa-gun (JP)

(73) Assignee: Roland Corporaton, Osaka (JP)

( * ) Notice: Subject to any disclaimer, the term of this patent is extended or adjusted under 35 U.S.C. 154(b) by 67 days.

(21) Appl. No.: 10/817,774

(22) Filed: Apr. 2, 2004

(65) Prior Publication Data

US 2004/0255765 A1 Dec. 23, 2004

(30) Foreign Application Priority Data

Apr. 11, 2003 (JP) ..... 2003-108376

(51) Int. Cl.
*G10H 1/02* (2006.01)

(52) U.S. Cl. ..... 84/737; 84/738

(58) Field of Classification Search ..... 84/737, 84/738, 742

See application file for complete search history.

(56) References Cited

U.S. PATENT DOCUMENTS 4,781,097 A * 11/1988 Uchiyama et al. ..... 84/738
5,009,146 A * 4/1991 Manabe et al. ..... 84/615
5,288,938 A * 2/1994 Wheaton ..... 84/600
5,399,801 A * 3/1995 Hasebe et al. ..... 84/622
6,031,176 A * 2/2000 Tanaka ..... 84/735

* cited by examiner

*Primary Examiner*—Jeffrey W Donels
(74) *Attorney, Agent, or Firm*—Foley & Lardner LLP

(57) ABSTRACT

An electronic percussion instrument modifies the effect applied to note generated in response to a strike based on the intensity of the strike. A plurality of patches are stored in the waveform memory. Each patch includes settings for the effects applied to each pad of the instrument. The patch also includes a setting indicating whether the parameters of the effects applied to the pads are to be modified in accordance with strike intensity. Subsequently, during performance, when a strike is detected the intensity of the strike is used to determine whether the parameters of the effect applied to the note are to be modified, and if so the parameters are modified in correspondence to the intensity of the strike. This allows the performer to easily modify the effect applied to the notes of the percussion instrument during performance.

20 Claims, 6 Drawing Sheets

ELECTRONIC PERCUSSION INSTRUMENT

BACKGROUND OF THE INVENTION

1. Field of the Invention

Embodiments of the present invention relate to an electronic percussion instrument.

2. Background Technology

An electronic percussion instrument is described in Japanese Official Patent Gazette Publication Number 2614746. In this instrument a respective waveform is assigned to each of a plurality of pads. When a pad is struck, the waveform that has been assigned to that pad is read out, a musical tone is generated, and the performance is carried out. If the striking intensity on the striking surface reaches or exceeds a specified threshold value, an effect is applied in correspondence to the striking intensity.

However, with this electronic percussion instrument, the performance can be done using the effects that have been set in advance for each pad in correspondence with the striking intensity, but it is not possible to modify the effects during the performance. Therefore, in order to modify an effect, it is necessary to interrupt the performance and reset the effect parameters. The effect must then be tested to determine whether it is being applied in the desired manner. This makes adjustment during performance difficult. Also, adjustments that require the use of knobs or buttons and the like are difficult for a performer who must hold drum sticks in both hands.

SUMMARY OF THE INVENTION

Embodiments of the invention provide an electronic percussion instrument in which it is easier to adjust effect parameters during performance.

In accordance with one embodiment, an electronic percussion instrument detects the striking intensity of strikes against its pads, and generates musical tones in response to the strikes in correspondence to the detected strike intensity. One or more effects are applied to the musical tones produced by the instrument, and the parameters of the effects may be modified in correspondence to the strike intensity of strikes against particular pads. A variety of configurations may be implemented. In one configuration, the instrument may be set up so that pads that produce notes also produce a change in effect parameters in correspondence with the intensity with which they are struck. In another configuration, the instrument may be set up so that one or more of the pads produces a change in effect parameters applied to other pads in correspondence with the intensity with which the one or more pads are struck.

The instrument may be configurable by the performer to specify which pads produce a change in effect parameters, and which parameters are affected. A variety of effects may be controlled in this manner, including a pitch shifter, flanger, filter, chorus, equalizer and reverb.

DETAILED DESCRIPTION OF PREFERRED EMBODIMENTS

An explanation will be given below concerning the first preferred embodiment of the present invention while referring to the attached drawings.

Figure 1:
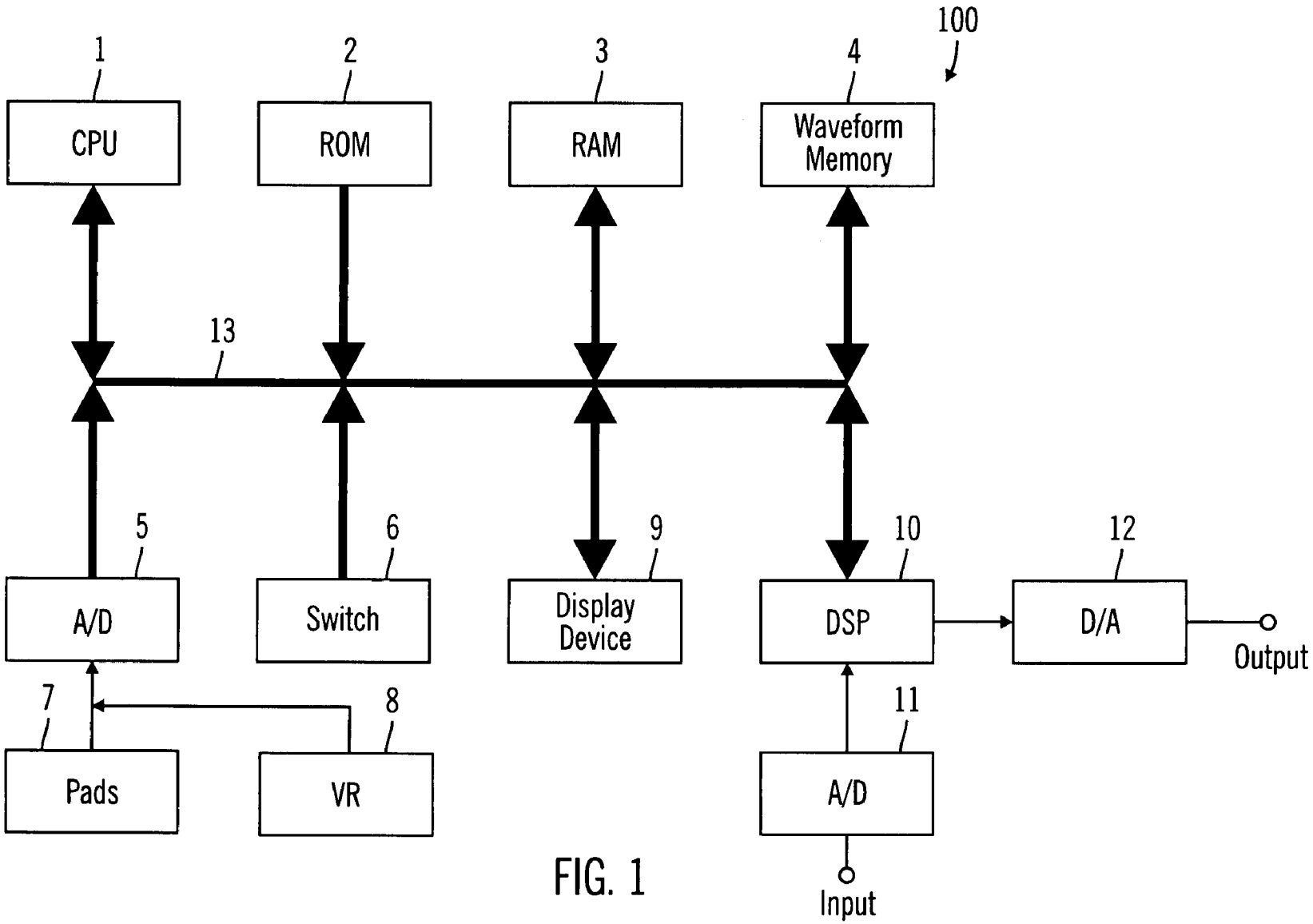
FIG. 1 shows the electrical configuration of the electronic percussion instrument in a first preferred embodiment of the present invention.

FIG. 1 is a block drawing that shows schematically the electrical configuration of the electronic percussion instrument 100 in the first preferred embodiment of the present invention. Installed in the electronic percussion instrument 100 are primarily the CPU 1, the ROM 2, the RAM 3, the waveform memory 4, the analog to digital converter (A/D) 5, which converts the analog signals that are input from the pad 7 and the VR (variable resistor) 8 into digital signals, the switches 6, the display device 9, the DSP 10, the bus line 13 that interconnects these components, the analog to digital converter (A/D) 11, which converts the analog signal that is input from the input terminal into a digital signal for processing by the DSP 10, and the digital to analog converter (D/A) 12, which converts the digital signal that is input from the DSP 10 for output as an analog signal to the outside through the output terminal.

The CPU 1 is the central processing unit that controls the entire electronic percussion instrument 100, the ROM 2 is a read only memory that stores the control program that is executed by the CPU 1 and various kinds of data tables and the like, the RAM 3 is a random access memory that has the working area in which various types of register groups that are required for the control programs that are executed by the CPU 1 are set and the temporary area in which data that are being processed are temporarily stored, and the like.

The waveform memory 4 is a nonvolatile memory such as a flash memory with which writing is possible and the like in which a plurality of waveform data, various kinds of parameters related to each of the waveform data, and a plurality of patches (timbre information that includes the assignment of waveform data to the nine pads 7*a* through 7*i*) are stored. In the waveform memory 4 preset waveform data (musical tone data) are stored and, together with this, waveform data that have been sampled by the user are stored. Incidentally, removable memory such as a Compact Flash (™) and the like may be used as the waveform memory 4.

The switches 6 are an operator group with which the setting of the parameters and the mode settings are carried out. In this first preferred embodiment, the switches include the push button 18, the effect selection button 19, the DEC button 21, the INC button 22, the patch selection button 23, the wave selection button 24, the mode selection button 25, and the like.

Figure 2:
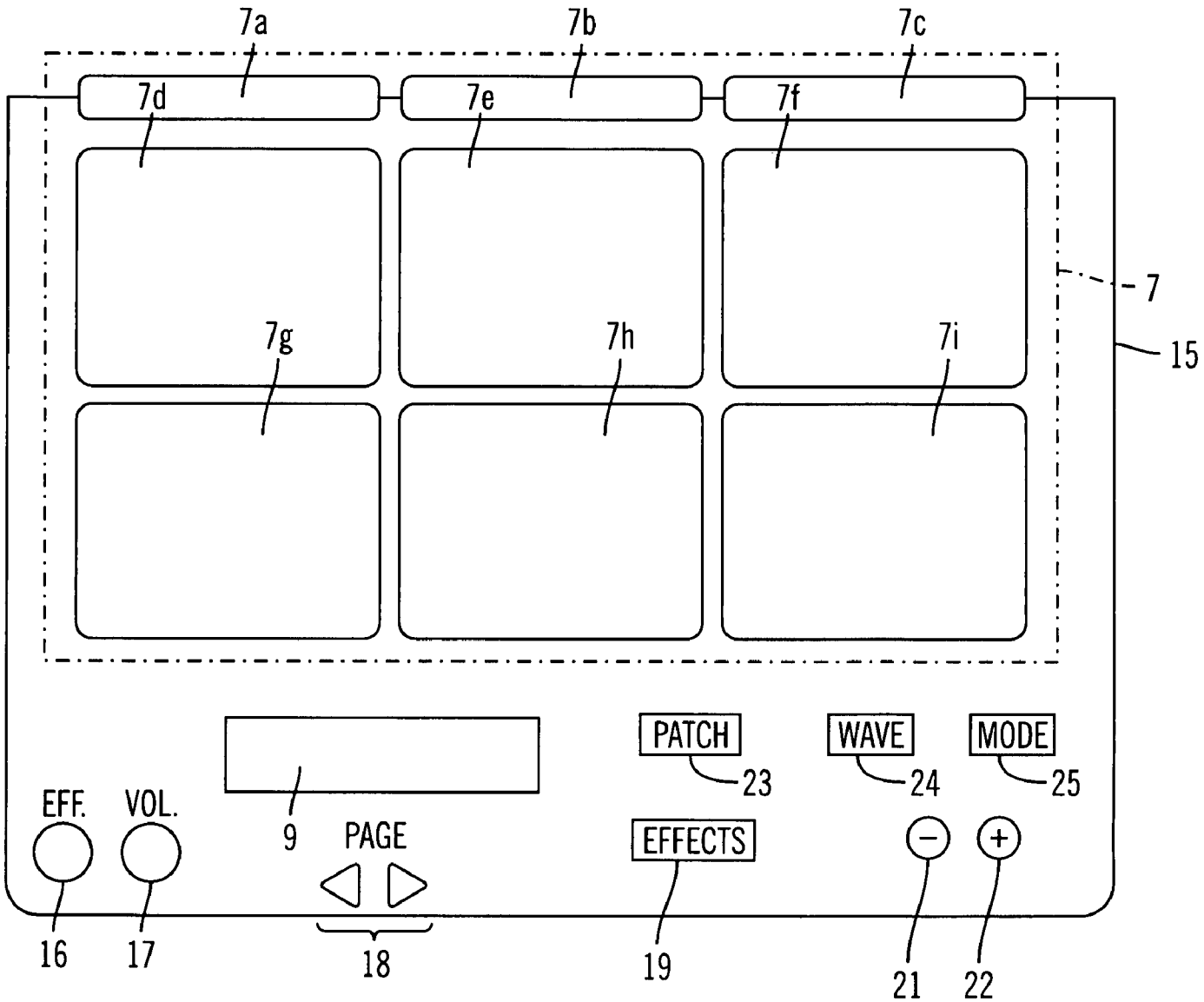
FIG. 2 is a front elevation of the operating panel of the electronic percussion instrument.

The pads (striking surfaces) 7 comprise nine pads 7*a* through 7*i* as shown in FIG. 2. Striking sensors (for example, piezo elements) not shown in the drawing are furnished on the rear surfaces of each of the pads 7*a* through 7*i*. The vibrations that are produced by the striking of a pad 7 are captured by the striking sensors and output to the A/D 5 as an analog electrical signal (a trigger signal). The analog electrical signal that has been input to the A/D 5 is converted into a digital signal, and that digital signal is detected by the CPU 1. A velocity value is set based on the digital signal that has been detected and this velocity is changed in correspondence with the striking intensity for each pad.

The VR 8 is a variable resistor such as a knob 16 for effect control, the knob 17 for volume adjustment, or an adjusting pedal (not shown in the drawing) that can be adjusted within a specified range and the like. The analog voltage value that has been output from the VR 8 is input to the A/D 5 and converted into a digital value, and that digital value is detected by the CPU 1.

The DSP 10 is a digital signal processor for processing the waveform data (the musical tone data) of the digital signal. The DSP 10 causes waveform data that have been sampled and digitized by the A/D 11 to be stored in the waveform memory 4. The DSP 10 also applies specified effects to digital waveform data that are read out from the waveform memory 4 and outputs this to the D/A 12.

FIG. 2 is a front elevation of the operating panel 15 of the electronic percussion instrument 100. The operating panel 15 is provided with nine pads 7*a* through 7*i* that serve as striking surfaces, a display device 9, an effect control knob 16 for control of the parameters of effects that are set, a volume control knob 17 for controlling the output sound level, a page button 18, an effect selection button 19, a decrease (DEC) button 21, an increase (INC) button 2, a patch selection button 23, a wave selection button 24, and a mode selection button 25.

The effect selection button 19 is a button for the selection of one parameter from among the parameters of the various kinds of effects that may be applied to the waveform data, the patch selection button 23 is a button for selecting one patch (timbre information) from the various kinds of patches that are stored in the waveform memory 4, and the wave selection button is a button for the selection of one set of waveform data from the various kinds of waveform data that are stored in the waveform memory 4. In addition, the mode selection button 25 is a button for carrying out the selection of the operating mode of the electronic percussion instrument 100. The operating modes of the electronic percussion instrument 100 of the first preferred embodiment include a performance mode for carrying out the performance, a setting mode for setting the various parameters, a recording mode for recording signals input from outside, and an editing mode with which editing of the waveform data is carried out.

The display device 9 is a unit for the display of the operating status of the electronic percussion instrument 100 (such as information on each of the various operating modes, each of the various parameter values, and the like). Specifically, screens are displayed that correspond to, for example, the parameters of the effect that has been selected by the effect selection button 19, the patch that has been selected by the patch selection button 23, the waveform data that have been selected by the wave selection button 24, or the operating mode that has been selected by the mode selection button 25. With the operating status displayed on the display screen, when the page switch (page SW) 18 is operated, the page of the display screen can be switched and the parameter selection, patch selection, and wave selection can be done. In addition, the value for the parameter that has been selected by the page SW 18 can be increased and decreased and input with the DEC button 21 and INC button 22.

Next, an explanation will be given regarding the configuration of the patch while referring to FIG. 3.

Figure 3:
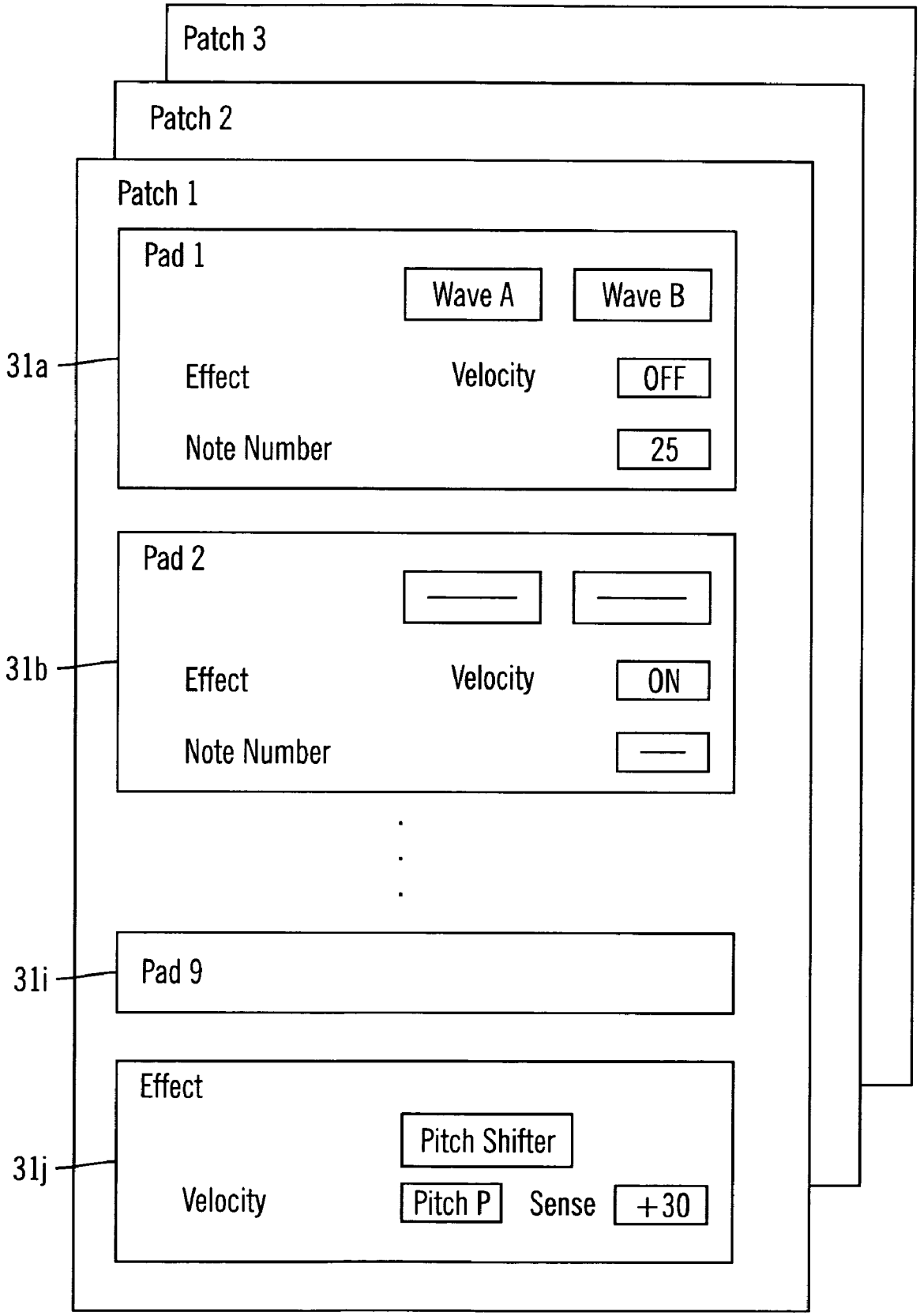
FIG. 3 shows the configuration of a patch in which each of the pads and the effect that is applied in common to the pads are set.

FIG. 3 is a drawing for the explanation of the configuration of the patch that is used to set the effect that is applied in common to the pads 7*a* through 7*i*. FIG. 3 shows patches 1 through 3 which are typical of patches stored in the waveform memory 4. The number of patches can be as desired. By setting the pads 7*a* through 7*i* and the effects that are applied in common to the pads 7*a* through 7*i* to a plurality of patches, it is possible for there to be a performance that conforms to the preferences of the performer even when there are configurations for nine pads.

An explanation will be given here regarding the configuration of the patch 1 as one example. The patch 1 includes regions 31*a* through 31*i* that set the various conditions for pads 1 through 9 that correspond to the pads 7*a* through 7*i*, and a region 31*j* that sets the effect. In this first preferred embodiment, the musical tones that are generated by a plurality of pads all have one effect input.

Referring to pad 1 (the region 31*a*), the setting of the wave that is assigned to the pad 1, the on/off for the velocity, and the note number can be set. In this first preferred embodiment, both the "wave A" and the "wave B" are assigned to the pad 1, and the "wave A" and "wave B" are stored as the waveform data A and the waveform data B in the waveform memory 4. In the performance mode, when the pad 1 is struck, by means of instructions from the CPU 1, the corresponding waveform data are read out from the waveform memory 4, the waveform data are supplied to the DSP 10, and an effect is applied to the musical tone by the DSP 10. Since the wave A and the wave B are assigned to the pad 1, two musical tones are generated, combined and performed.

The on/off setting determines whether or not the parameters of the effect that is applied to the waveform data are modified based on the velocity value. In those cases where it is "on," the parameters of the effect are modified by the effect processing that will be discussed later and the effect is applied to the musical tone by the DSP 10 based on the parameters that have been modified. In those cases where the velocity is "off," the effect is applied to the musical tone by the DSP 10 based on the parameters of the effect that have been set in advance and the parameters are not modified by the striking of the pad. Here, for pad 1, "off" has been set and so the parameters of the effect are not modified in correspondence with the velocity, whereas "on" has been set for pad 2 and so the parameters of the effect are modified in correspondence with the velocity. In addition, in this drawing, since a waveform has not been assigned to the pad 2, a musical tone is not generated when this pad is struck and only the parameters of the effect are modified in correspondence with the striking intensity.

With regard to the note number, when the striking of the pad is detected, a MIDI standard note-on signal is output using the stored note number. The velocity that corresponds to the striking intensity is output as the velocity value of the note-on signal. In this drawing, for the pad 1, the note number 25 is shown and for the pad 2, no assignment is shown.

Incidentally, for purposes of this example, the wave, velocity on/off, and note number for pad 3 through pad 9 are set in the same manner as for pad 1.

The effect region 31*j* is used to set a type of effect and parameter values, as well as an indicator of which operator or velocity modifies the parameters of the effect. Here, the pitch shifter is selected as the type of effect. Among the parameters, there are the pitch (the pitch shift amount P), the feedback (the amount of feedback to the input of the delayed signal), and the balance (the ratio of the level of the input signal and the level of the effect applied signal), and the selection of the parameter that is to be modified by the velocity can be specified. Here, the pitch P is selected. The fact is shown that the value of the sensitivity for the velocity value is set as the sense S plus 30. For the pitch shifter, musical tones that are input with known effects are stored sequentially in memory and the pitch is changed by changing the writing speed and the readout speed. With regard to the pitch shifter, as parameters, there are the two parameters of the pitch P and the sense S. The pitch P is modified in the range of 0 to 127 and the sense S is modified in the range of −63 to +64. With regard to the case where the value of the pitch P is 64, this is a value with which there is no pitch shift and the pitch becomes higher as the value increases and lower as the value decreases.

Figure 4A:
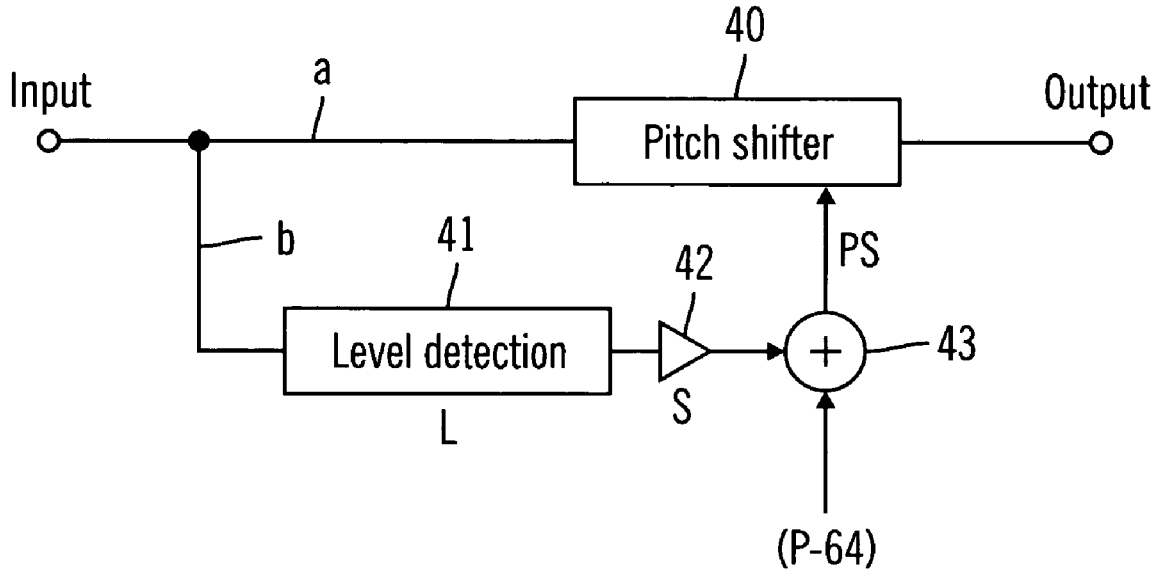
FIG. 4*a* and FIG. 4*b* show an example of the operation of a pitch shifter.
Figure 4B:
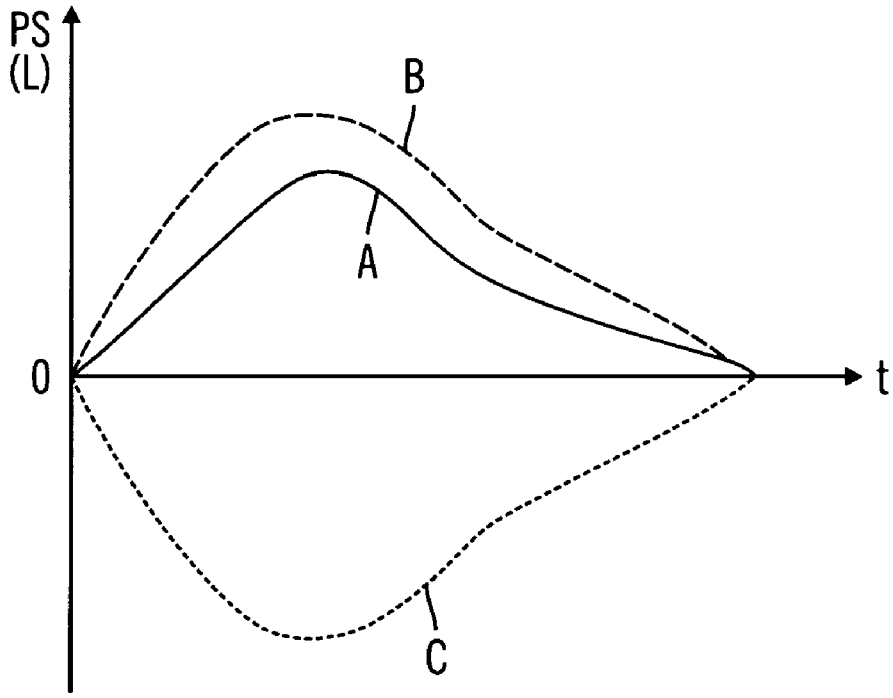

An explanation will be given here regarding an example of the operation of the pitch shifter while referring to FIG. 4. FIG. 4 is an explanatory drawing that shows an example of the operation of the pitch shifter. FIG. 4(*a*) shows the operating circuit of the pitch shifter and FIG. 4(*b*) shows the state of the waveform that is modified by the pitch shifter. In FIG. 4(*b*), the horizontal axis represents the time t and the vertical axis represents the pitch shift amount (PS) or the level (L).

Waveform data are input from the input side shown in FIG. 4(*a*) and are divided into two: waveform data that are input to the pitch shifter 40 through the line a, and waveform data that are input to the level detection device 41 through the line b.

For the waveform data that are input to the level detection device 41, the level L of the waveform data (the envelope) is detected by the level detection device 41. The waveform that is input in this case is the waveform A in FIG. 4(*b*) and the vertical axis becomes L. When the level L of the waveform data is detected, the level is multiplied by the sense S (L×S) with the multiplier 42. The sense S is a value that is set in advance by the effect in the patch and is a constant that modifies the pitch shift amount. When the level L and the sense S are multiplied with the multiplier 42, a value, which is the pitch value P less "64," is added (L×S+(P−64)) with the adder 43. This value becomes the pitch shift amount PS. Incidentally, the value of the pitch P is a variable that changes in proportion to the value of the velocity; and, for its calculation, a specified constant a is multiplied with the velocity (Vel), "64" is added to this value (a×Vel) and it is derived (P=64+a×Vel). Incidentally, the constant a is a value that is set in advance for the sense with respect to the velocity. "64" is the median value for the pitch P (0 to 127) and the pitch shift amount PS is calculated with "64" as the reference.

The waveform B and waveform C of FIG. 4(*b*) show the case in which the value of the pitch P is the reference "64." Because of that, the computation of the pitch shift amount PS changes in accordance with the setting of the sense S (PS=L×S). The waveform B shows the condition in which the value of the sense S is set on the plus side, and the waveform C shows the condition in which the value of the sense S is set on the minus side.

With the pitch shifter 40, the pitch of the waveform that has been input through the line is modified only by the pitch shift amount P and output. Therefore, it is possible to modify the musical interval of the waveform data by means of the value of the sense S, the value of the velocity and the like.

With regard to the types of effects, in addition to the pitch shifter, there are those such as the flanger that controls the delay of the waveform data and filters that exclude specified frequency bands (not shown in the drawing). The flanger is something that periodically makes the delay time earlier and later, setting the rate of the period and the depth of the amplitude. The rate and depth are the parameters of the flanger, and those values can be modified in proportion to the amount of change in the velocity in the same manner as the modification of the pitch P. With regard to the filters, there are high-pass filters, with which the bands that are lower than the cut-off frequency are cut, low-pass filters, with which, on the contrary, the bands above are cut, and band-pass filters, with which the bands other than those in the vicinity of the cut-off frequency are cut. It is possible to set the filters as desired; and, together with this, any cut-off frequency can be set as desired in proportion to the amount of change in the velocity. Incidentally, various kinds of effects may be provided such as a chorus, an equalizer, a reverb, and the like, not only the flanger and filters.

Figure 5:
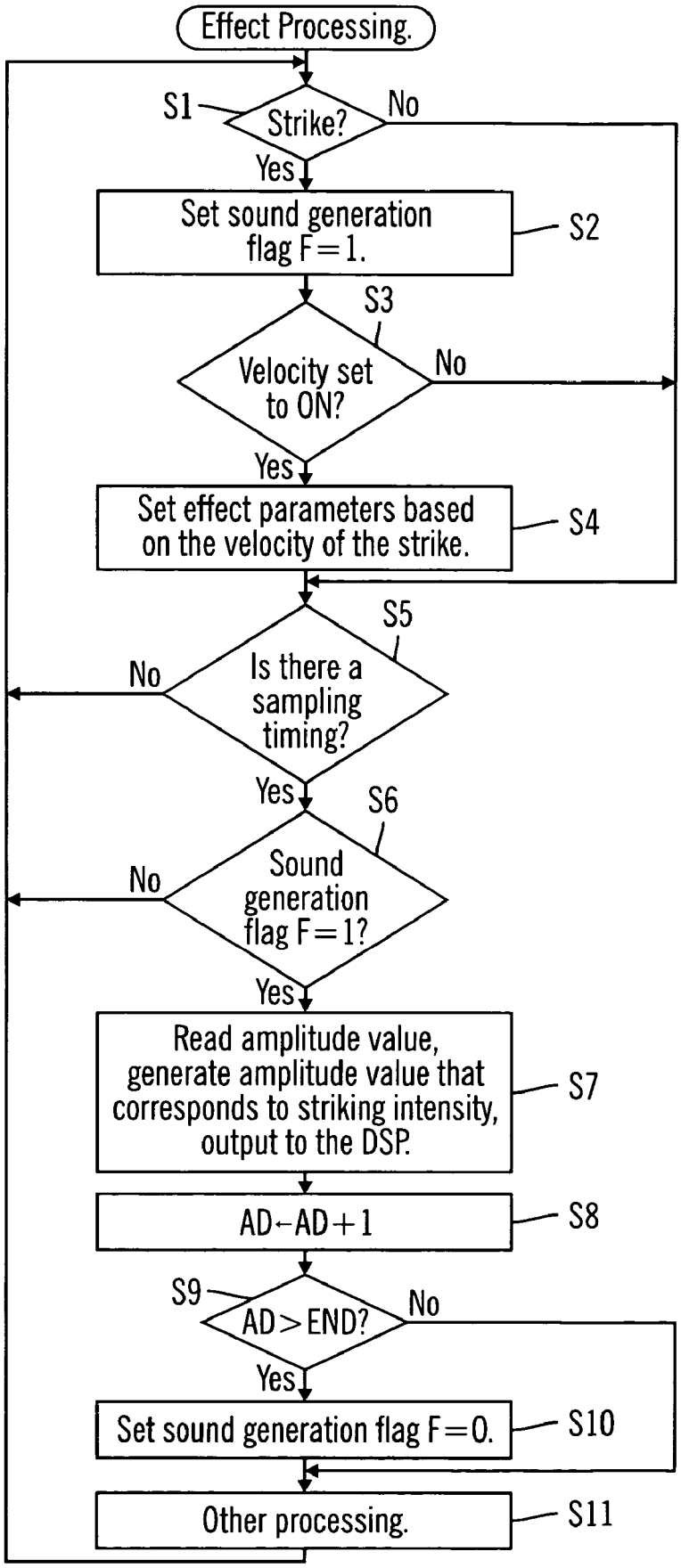
FIG. 5 shows effect processing that is executed by the CPU.

Next, an explanation will be given regarding the processing that is executed by the electronic percussion instrument 100 that has been configured as described above while referring to the flowchart of FIG. 5. FIG. 5 is a flowchart that shows the effect processing that is executed by the CPU 1 when the performance mode has been selected. This processing is performed in parallel for the nine effect processes for the pads 7*a* through 7*i*.

When the effect processing is executed, a determination is made as to whether a pad has been struck or not (S1). In those cases where a pad has been struck, the striking intensity is detected by the striking sensor at the same time and the velocity is set based on that value. When the result that has been ascertained by the processing of S1 is a determination that there has been a striking (S1: yes), the sound generation flag F for the sound generation channel that corresponds to the wave that is assigned to the pad is set to "1" (S2). In this example it is assumed that patch 1 is used and that the pad that has been struck is pad 1. In addition, in those cases where a plurality of waves are assigned to one pad, the sound generation flags F for the plurality of sound generation channels are each set to "1" but in the following illustration, the explanation will be given for the case in which the sound generation flag F is set to "1" for one sound generation channel.

When the sound generation flag F has been set to "1," a determination is made as to whether or not a parameter of an effect is to be modified based on the value of the velocity for the pad 1 of the patch 1 (S3). If the result of this is that the velocity has been set to "on" in the pad 1 (S3: yes), the parameter of the effect (here, it is the pitch shift amount P) is set to the DSP 10 based on the value of the velocity (S4) When the effect has been set, the setting is output to the DSP 10 and the processing advances to the processing of S5.

On the other hand, in those cases where there has been no striking of a pad in the processing of S1 (S1: no), the processing advances to the processing of S5 without setting the sound generation flag F to "1" and in those cases where the velocity has been set to "off" in S3 (S3: no), the processing advances to the processing of S5 without setting an effect based on the value of the velocity.

In the processing of S5, whether or not there is a sampling timing is ascertained. The sampling timing is ascertained for reading out the waveform data that are stored in the waveform memory 4 at the sampling frequency (for example, 44.1 kHz) and, in this first preferred embodiment, a circuit is furnished with which a flag "1" that is not shown in the drawing is provided for each sampling frequency and the processing is executed by identifying the flag. Therefore, if this flag is "1" (S5: yes), the processing advances to the processing of S6 and if the flag is not "1," since there is still no sampling timing (S5: no), the processing of S1 is returned to and the effect processing is repeated and executed.

When it has been ascertained that there is a sampling timing in the processing of S5, whether or not the sound generation flag F is set to "1" is ascertained. If the sound generation flag F is "1" (S6: yes), the processing that comes after this continues and is executed. If the sound generation flag F is not "1" (S6: no), the processing returns to the processing of S1 and the effect processing is repeated and executed until a pad is struck.

When it is ascertained in the processing of S6 that the sound generation flag F is set to "1," the amplitude value of the waveform data that correspond to the sound generation channel for which the sound generation flag F is "1" is read out from the waveform memory 4 and an amplitude value that corresponds to the striking intensity is generated and output to the DSP 10 (S7). The generation of the amplitude value that corresponds to the striking intensity is for the purpose of producing a volume that corresponds to the striking intensity. The amplitude value is made larger as the striking becomes stronger; and, conversely, the amplitude value is made smaller as the striking becomes weaker. The amplitude value that has been output to the DSP 10 has the effect that has been modified in S4 with the DSP 10 or the modification of the effect that has been set in advance applied and is output to the outside.

When the amplitude value has been output to the DSP, the address value of the waveform data that are read out is advanced by "1" (S8) and it is determined whether or not that address value is the end address (END) (S9). If the result is that the address value is the end address (S9: yes), since the waveform data that are performed have been completed, the sound generation flag F is set to "0" (S10).

On the other hand, if it is determined that the address value was not the end address, or in those cases where the sound generation flag F has been set to "0" in S10, other processing is executed (S11). The other processing is processing in which the operating state of each of the various operators is detected or, in those cases where an operator has been operated, processing that corresponds to that operator. When the execution of the other processing is instructed, the processing of S1 is returned to and the effect processing is repeated and executed during the period of the performance mode.

The effect processing discussed above is executed for each pad, and the parameters of the effects are modified in correspondence with the striking intensity for the pad and applied. For that reason, it is possible to easily modify the effect that is applied and carry out the performance, and the effect can also be easily modified for the pad during the performance. In addition, it has been set up such that in those cases where the velocity has been set to "on," when the pad is struck, the waveform data that are assigned to that pad are read out, the modified effect is applied and the musical tone is produced. However, it may be arranged such that the setting is made to only modify the effect, specifically, a setting to make one of the pads a pad that instructs the performance and termination of the waveform data and the other pads ones that modify the parameters of the effects that are applied to the waveform data during the performance. With this setting, by means of striking any of the pads, it is possible for the performer, during the performance, to easily modify the parameters of the effects and carry out the performance.

In addition, it is possible to also easily modify the type of effect that is applied during the performance when that pad is struck during the performance by setting up the system such that one of the pads instructs the modification of a patch that is stored in the waveform memory 4. Furthermore, the system may be set up such that one of the pads is assigned as a pad that stops the entire performance when struck. Therefore, the performance can be easily carried out in correspondence with the preferences of the performer.

Figure 6:
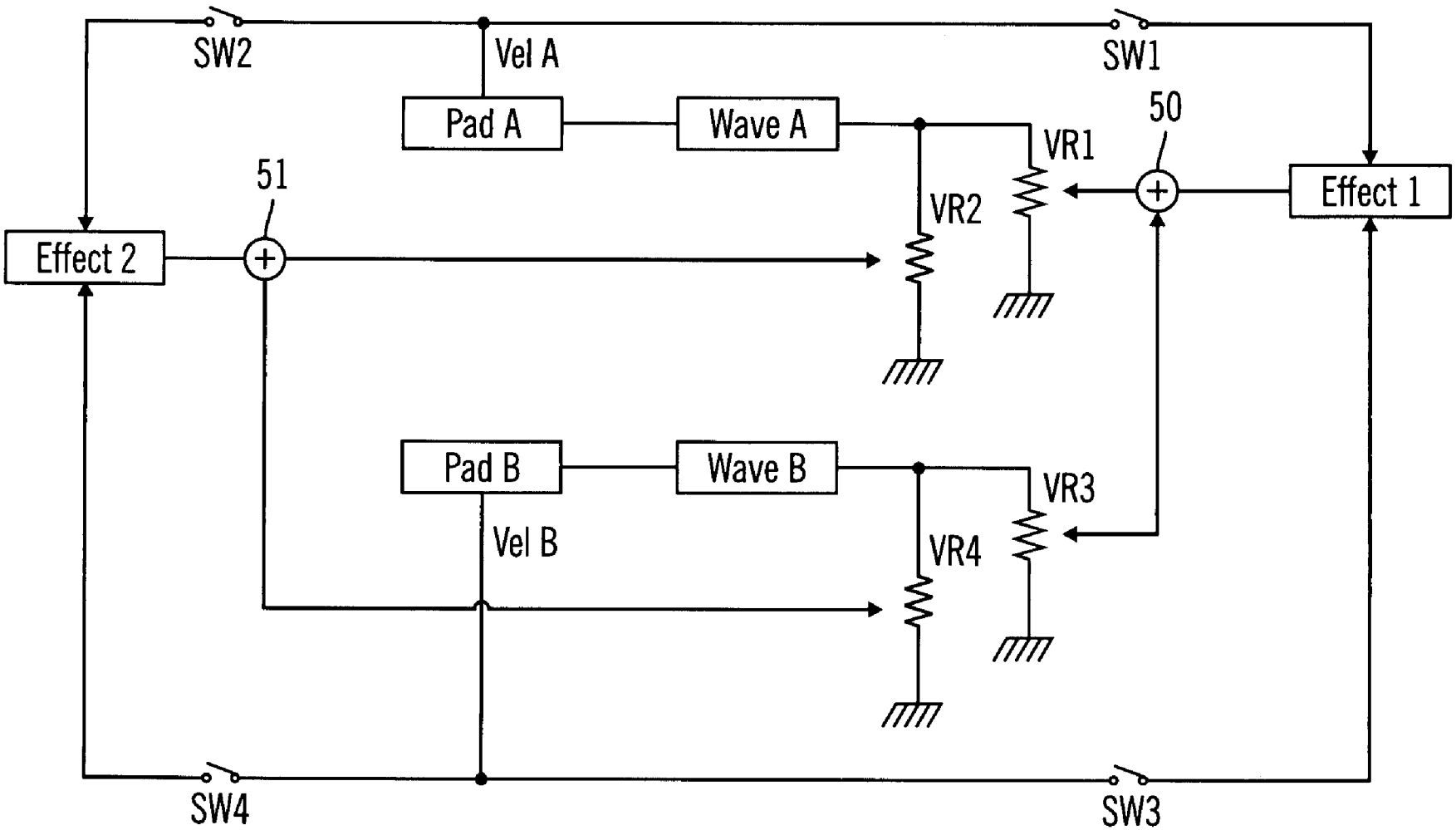
FIG. 6 shows an operating circuit for the effect processing of a second preferred embodiment.

FIG. 6 is a circuit drawing that shows the effect processing of the second preferred embodiment. The first preferred embodiment is set up such that one effect is used for all of the nine pads 7*a* through 7*i*. In contrast, in the second preferred embodiment a plurality of effects are set as desired.

As is shown in FIG. 6, the wave A is assigned to the pad A and, when the pad A is struck, the volume is adjusted by the VR 1 for the wave A and the wave is supplied to the adder 50. Together with this, the volume is adjusted by the VR 2 and the wave is supplied to the adder 51. With regard to the velocity value (Vel A), which is the pad A striking intensity, it is configured so that it is possible for the output to the effect 1 to be turned on and off by the SW 1 and configured so that it is possible for the output to the effect 2 to be turned on and off by the SW 2.

In addition, the wave B is assigned to the pad B and, when the pad B is struck, the volume is adjusted by the VR 3 for the wave B and the wave is supplied to the adder 50. Together with this, the volume is adjusted by the VR 4 and the wave is supplied to the adder 51. With regard to the velocity value (Vel B), which is the pad B striking intensity, it is configured so that it is possible for the output to the effect 1 to be turned on and off by the SW 3 and configured so that it is possible for the output to the effect 2 to be turned on and off by the SW 4.

With the adder 50, in those cases where either one of the pad A or the pad B has been struck, the waveform data for the one that has been struck are supplied to the effect 1 and, in those cases where both the pad A and the pad B have been struck, the waveform data for the pad A and the waveform data for the pad B are combined and supplied to the effect 1. In addition, the adder 51 operates in the same manner and supplies the waveform data to the effect 2.

In other words, in the second preferred embodiment, by setting which effect is used with each of the pads, it is possible to use a plurality of effects at the same time and carry out the performance. In addition, the wave data that are assigned to each of the pads, and the number of effects and the like can be set as desired and the performance can be carried out in correspondence with the preferences of the performer.

Incidentally, in the flowchart, the processing of S1 in those cases where a pad has been struck corresponds to the detection means cited in claim 1, the processing of S4 corresponds to the modification means, and the processing of the DSP 10 that is executed by the instruction of S7 corresponds to the generation means and the effect application means. In addition, the setting of the velocity on and off in the patch of FIG. 3 corresponds to the setting means cited in claim 1.

An explanation has been given above based on preferred embodiments; however, the present invention is not restricted in any way to the preferred embodiments described above and the possibility of various modifications and variations can be easily conceived of that do not deviate from and are within the scope of the essentials of the present invention.

For example, in the preferred embodiments described above, it was set up such that each of the parameters of the effects was modified based on the velocity value, but it may also be set up such that the modification is based on the amount of operation of the effect control knob 16 or an adjustment pedal (not shown in the drawing) and the like. With these, for the striking of a pad, only the existence of the strike is detected, and the modification of the parameters of the effect is a modification that is based on the amount of operation of the effect control knob 16 or the adjustment pedal. Because of this, it is possible to modify the effect that is applied in real time during the performance.

In addition, in the preferred embodiments described above, when the performance mode is selected, since the settings of the effects for the waves that have been stored for each pad are output to the DSP 10, it has been set up such that one of the effects is applied and a musical tone is generated. However, it may be set up such that a musical tone is generated while an effect is not applied. In this case, an effect on/off setting item is provided for the setting region of each pad in the patch; and, in the case of "off," the musical tone is generated while the effect is not applied to the waveform data.

In addition, in the preferred embodiments described above, it was set up such that the same effect is set for a plurality of pads in a single setting step. However, the patch may be set up such that a different effect is assigned to each pad individually.

In addition, in the preferred embodiments described above, it has been set up such that when the waveform data that have been assigned to the pad have ended (END), the sound generation flag F is set to "0" and the performance terminates. However, it may be set up such that a pad or a button and the like is assigned that instructs the termination of the performance; and, until the performance termination is instructed by the operation of that pad or button, the data are repeated and the performance is carried out.

What is claimed is:

1. An electronic percussion instrument, comprising:

a plurality of pads;

detection means for detecting the striking intensity when a pad is struck;

tone generation means for generating a musical tone in correspondence to a detected striking intensity;

effect application means for applying one or more effects to a tone generated by the tone generation means;

effect modification means for modifying parameters of the one or more effects applied by the effect application means in correspondence to the striking intensity detected when a pad is struck; and setting means associated with one or more of the pads, for selecting and setting a first and a second state wherein, in the first state the parameters of the one or more effects are modified by the effect modification means in response to a strike of the one or more associated pads and, in the second state the parameters of the one or more effects are not modified in response to a strike of the one or more associated pads.

2. The electronic percussion instrument claimed in claim 1, wherein the detection of a strike of a pad by the detection means causes the effect modification means to modify parameters of the one or more effects applied in response to the strikes of that pad.

3. The electronic percussion instrument claimed in claim 1, wherein the setting means further sets selected parameters for modification by said effect modification means from among a plurality of parameters of an effect applied by the effect application means.

4. An electronic percussion instrument, comprising:

a plurality of pads;

detection means for detecting the striking intensity when a pad is struck;

tone generation means for generating a musical tone in correspondence to a detected striking intensity;

effect application means for applying one or more effects to a tone generated by the tone generation means;

effect modification means for modifying parameters of the one or more effects applied by the effect application means in correspondence to the striking intensity detected when a pad is struck; and setting means for selecting a type of effect from a plurality of types of effects that are modified by the effect modification means, wherein the modification means modifies one or more parameters of the effect type selected by the setting means in correspondence to the striking intensity.

5. A programmable electronic percussion instrument, comprising:

a plurality of pads that are struck to produce tones; and a computer readable medium storing programming code for controlling the percussion instrument to perform processing comprising:

detecting the intensity of strikes against the pads;

generating musical tones in response to detected strikes;

applying one or more effects to the musical tones generated in response to the detected strikes;

modifying the parameters of the one or more effects in correspondence to the detected intensity of strikes of one or more predefined pads; and receiving user input for selecting and setting a first and a second state for at least one of the pads wherein, in the first state the parameters of the one or more effects are modified by the effect modification means in response to a strike of the at least one pad and, in the second state the parameters of the one or more effects are not modified in response to a strike of the at least one pad.

6. The programmable electronic percussion instrument claimed in claim 5, wherein said processing further comprises receiving further user input specifying further configuration data for one or more of said pads.

7. The programmable electronic percussion instrument claimed in claim 6, wherein said configuration data comprises data indication a note number of a note to be produced in response to strikes of that pad.

8. The programmable electronic percussion instrument claimed in claim 5, wherein said processing further comprises receiving user input specifying modifications to be applied to parameters of said one or more effects.

9. The programmable electronic percussion instrument claimed in claim 5, wherein the instrument is configured such that strikes of a predefined pad modify the effects applied to notes produced in response to strikes of other pads.

10. The programmable electronic percussion instrument claimed in claim 5, wherein said one or more effects include a flanger.

11. The programmable electronic percussion instrument claimed in claim 5, wherein said one or more effects include a filter.

12. The programmable electronic percussion instrument claimed in claim 5, wherein said one or more effects include a chorus.

13. The programmable electronic percussion instrument claimed in claim 5, wherein said one or more effects include a equalizer.

14. The programmable electronic percussion instrument claimed in claim 5, wherein said one or more effects include a reverb.

15. A programmable electronic percussion instrument, comprising:

a plurality of pads including one or more first pads that are struck to produce tones; and at least one second pad that is struck to modify parameters of one or more effects applied to said tones, processing electronics operatively coupled to the plurality of pads that produces tones in response to strikes of one or more of said first pads, and adjusts parameters of one or more effects applied to said tones in correspondence to the intensity of strikes of said at least one second pad; and a selector arrangement for allowing a user to select and set at least one of: (1) an effect from a plurality of selectable effects, wherein each of the selectable effects has at least one parameter that is adjustable by the processing electronics in correspondence to the intensity of strikes of said at least one second pad; and (2) a first and second state wherein, in the first state the parameters of the one or more effects are adjusted by the processing electronics in response to at least one strike of said at least one second pad and, in the second state the parameters of the one or more effects are not adjusted in response to at least one strike of the at least one second pad.

16. The programmable electronic percussion instrument claimed in claim 15, wherein the instrument is configurable to specify parameters of the one or more effects to be modified in response to strikes of said second pad.

17. The programmable electronic percussion instrument claimed in claim 15, wherein the instrument is configurable to specify which pads of the device comprise said first pads and which pad of the device comprises said second pad.

18. The programmable electronic percussion instrument claimed in claim 15, wherein the selector arrangement further comprises a selector for allowing a user to select which pads of said plurality of pads comprise said one or more first pads and which pad of said plurality of pads comprises a second pad.

19. The programmable electronic percussion instrument claimed in claim 15, wherein said plurality of selectable effects comprise of at least one of the group consisting of a flanger, a filter, a chorus, an equalizer and a reverb.

20. The programmable electronic percussion instrument claimed in claim 5, wherein said processing further comprises:

receiving user input specifying a selection of a type of effect from a plurality of types of effects that may be modified by the effect modification means;

wherein modifying the parameters comprises modifying one or more parameters of the selected effect type in correspondence to the striking intensity.

* * * * *